United States Patent [19]

La See

[11] Patent Number: 4,790,106

[45] Date of Patent: Dec. 13, 1988

[54] CAM ADJUSTMENT DEVICE

[76] Inventor: Jack C. La See, 308 W. Cedar, Abbotsford, Wis. 54405

[21] Appl. No.: 115,851

[22] Filed: Nov. 2, 1987

[51] Int. Cl.[4] ..... E05D 15/30

[52] U.S. Cl. ..... 49/252; 49/396

[58] Field of Search ..... 49/396, 260, 250, 251, 49/252, 505, 190, 191; 52/291

[56] References Cited

U.S. PATENT DOCUMENTS

| | | | |
|---|---|---|---|
| 1,256,839 | 2/1918 | Soule | 49/251 |
| 1,489,350 | 4/1924 | Hauser | 49/252 |
| 1,710,171 | 4/1929 | Lindsay | 49/252 |
| 2,688,779 | 9/1954 | Westman | 49/252 |
| 2,791,810 | 5/1957 | Perry | 49/251 |
| 3,103,351 | 9/1963 | Ahlgren | 49/252 |

*Primary Examiner*—Kenneth J. Dorner
*Assistant Examiner*—Gerald A. Anderson
*Attorney, Agent, or Firm*—Herman H. Bains

[57] ABSTRACT

An improved casement window sash unit includes a pair of track and hinge assemblies, each being secured to one of the upper and lower horizontal window frame members of a window opening in a building. Each track and hinge assembly includes a track having a toggle hinge pivotally and slidably secured thereto and to the sash. The track for each assembly has a pair of elongate longitudinally extending openings therein, each accommodating an attachment screw therethrough, each opening being of a size to permit slight longitudinal shifting of the track relative to the window frame. Each track and hinge assembly includes a cam positioned within a cam opening in the track and secured to the track and window frame by an attachment screw. Each cam is selectively shiftable in either direction from a centered position to slightly shift the track longitudinally of the window frame before the attachment screws are tightened to adjust the position of the hinge relative to the window frame and thereby overcome sash sag.

4 Claims, 1 Drawing Sheet

CAM ADJUSTMENT DEVICE

This invention relates to an adjustable casement sash unit, which is effective in correcting sash sag.

BACKGROUND OF THE INVENTION

One of the common problems associated with residential casement windows is sash sag. Sash sag is the expression used to describe the misalignment of the sash to the casement window frame. The casement sash tends to tilt outwardly because of the location of the center of gravity.

Sash sag is usually caused by poor installation of the window unit into the home; i.e., the frame is not properly squared. Poor hinge positioning by the window manufacturer also causes sash sag. Sash sag could be easily corrected in the field during installation if the position of the hinge were adjustable. Unfortunately, in conventional commercial casement sash units, the position of the hinge is no adjustable.

SUMMARY OF THE INVENTION

It is an object of this invention to provide a conventional casement sash unit with cam mechanisms, each of which is operable for shifting the associated track of the casement sash to adjust the position of the hinge and thereby correct sash sag during or after installation of the casement window.

In carrying out this invention, the upper and lower tracks of a casement sash unit ar each provided with a small cam mechanism, which is operable to shift the track and the hinge mounted thereon relative to the window frame. This adjustment of the hinge position for the upper and lower tracks is sufficient to overcome sash sag. The adjustment is done during installation of the casement sash unit and requires only the actuation of the cam mechanisms, where necessary. The only alteration required by manufacturers to incorporate the present invention in conventional sash units is a slight enlargement of the holes for the conventional attachment screws, a slight shortening of each track, and the provision of the cam mechanism.

FIGURES OF THE DRAWING

DESCRIPTION OF THE PREFERRED EMBODIMENT

Figures 1, 2, 3, 4, 5, 6:
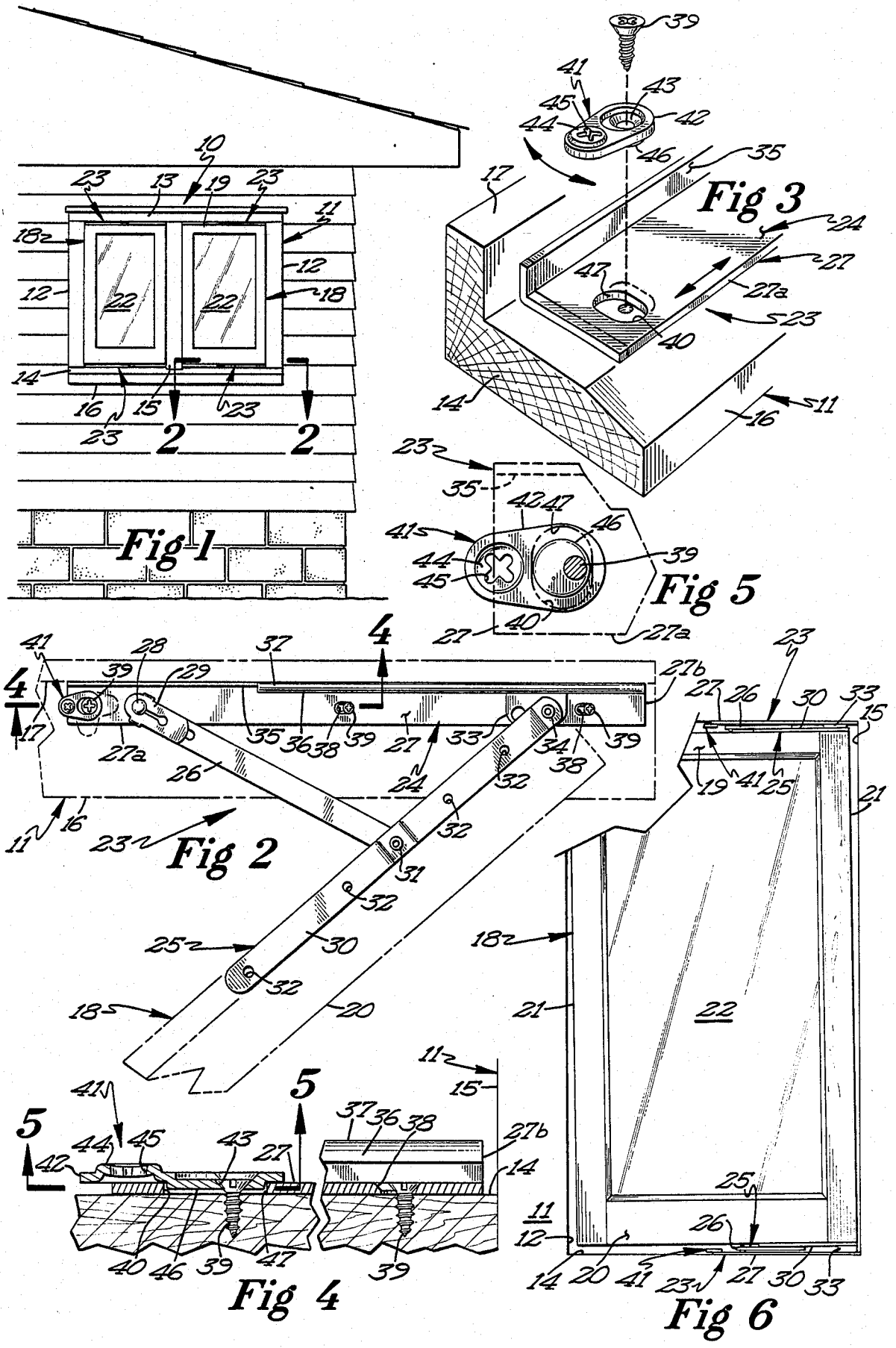
FIG. 1 is an elevational view of a conventional double sash casement unit employing the novel invention.
FIG. 2 is a plan view of the lower track and hinge assembly of the casement sash unit taken approximately along the line 2—2 of FIG. 1 and looking in the direction of the arrows.
FIG. 3 is a fragmentary partially exploded perspective view of a portion of the window frame and casement sash unit illustrating the novel cam.
FIG. 4 is a cross-sectional view taken approximately along the line 4—4 of FIG. 2 and looking in the direction of the arrows.
FIG. 5 is a bottom plan view of the cam mechanism taken approximately along the line 5—5 of FIG. 4 and looking in the direction of the arrows.
FIG. 6 is an elevational view of a casement window illustrating sash sag.

Referring now to the drawings and, more specifically, to FIG. 1, it will be seen that a double sash casement window unit, designated generally by the reference numeral 10, is thereshown. The casement window unit 10 includes a conventional window frame 11 comprised of vertical frame members 12, upper horizontal frame member 13, lower horizontal frame member 14, and a centrally located vertical mullion 15. The lower horizontal frame member 14 is provided with a conventional stop 17 and a sill 16 of well-known construction. It is also pointed out that the upper horizontal frame member is of conventional construction and is also provided with a conventional stop.

The casement window sash 18 also includes an upper frame member 19, a lower frame member 20, and spaced apart vertical frame members 21 extending between and rigidly interconnecting the upper and lower frame members. The casement window sash 18 also includes a transparent pane 22 and is provided with upper and lower track and hinge assemblies 23 which mount the casement window sash to the window frame. The upper and lower track and hinge assembly for each casement window sash comprises a track and hinge assembly set.

Each upper and lower track and hinge assembly 23 includes an elongate track 24 having a conventional toggle hinge 25 mounted thereon. The toggle hinge 25 includes an elongate link 26, which is pivotally connected to the horizontal track plate 27 by a pivot 28 to permit horizontal pivoting of the link about a vertical axis. The link 26 is provided with a conventional locking clip 29 for locking the pivot in place in a well-known manner.

The outer end of link 26 is pivotally connected to the mid-portion of an elongate link 30 by a pivot 31. The link 30 is provided with a plurality of longitudinally spaced apart openings 32 therein through which attachment screws project for securing the link to the casement window sash. Since the lower track and hinge assembly is illustrated in FIG. 2, the link 30 is secured to the lower frame member 20 of the casement window sash 18. A corresponding link in the member of the casement sash unit. The inner end of the link 30 is pivotally connected to a slide block 33 by a pivot 34.

It will be seen that the horizontal track plate 27 of the track 24 is provided with a vertical flange 35, which is positioned against the stop 17. A major portion of the flange 35 is provided with an arcuate overhang portion 36 to define a track 37 for engagement with the slide block 33 in a well-known manner. During opening and closing of the sash, the slide block 33 will move longitudinally along the track 37 during pivotal movement of the link 26. The casement sash unit described thus far comprises a conventional commercial casement sash unit.

Referring again to FIG. 2, it will be seen that the horizontal track plate 27 is provided with a plurality of longitudinally spaced apart openings 38 therein, which accommodate screws 39 for securing the track and hinge assembly to the associated frame member. It will be noted that the openings 38 are elongated in a longitudinal direction and two such openings are illustrated for the particular track and hinge assembly shown.

In this regard, it is pointed out that the openings 38 differ from the openings in the conventional casement window sash unit by being elongated 1/16 inch in either direction from the center of the original opening therein. This allows slight longitudinal movement of the track 24 relative to the attachment screws 39 and the associated frame for the sash unit. It will also be noted that the track 24 is also provided with an end opening 40, which is elongated transversely of the track. In this respect, the opening 40 differs from the corresponding end opening in a conventional commercial casement sash track by being enlarged and elongated. The opening 40 is first enlarged to have a 5/16 diameter and thereafter is extended 1/16 inch towards the longitudinal edge 27*a* of the horizontal track plate 27. It is also pointed out that the track 24 is shortened 1/16 inch to define the end edge 27*b* opposite the opening 40. The length of each track plate 27 is always less than the length of the associated window frame member. This arrangement permits the track to be shifted longitudinally 1/16 inch in either direction of center relative to the associated window frame. The track is, therefore, capable of shifting a total of ⅛ inch in a linear direction.

The means for shifting the track and hinge assembly comprises a cam 41, which is comprised of an elongate cam body having an opening 43 therein for accommodating an attachment screw 39 therethrough. The attachment screw 39 is identical to the attachment screw for the openings 38. The first opening 43 is counterbored to permit fitting of the screw head within the opening. The cam body 42 is provided with an embossed element 44, which has a second opening 45 shaped to accommodate a Phillips head screwdriver for facilitating turning of the cam 41 about the pivot defined by the screw 39. The cam body 42 is also provided with a depending cam element of circular configuration, but eccentrically arranged with respect to the screw 39. The cam element 46 is disposed in engaging relation with the cam edge surface 47 defined by the opening 40.

It is pointed out that the cam 41 is shiftable from a central position, illustrated by dotted line configuration in FIG. 2, in either direction through an arc of approximately 180 degrees. The position depicted in full-line configuration of FIG. 2 shifts the corresponding track 24 to the left, as viewed in FIG. 2. The movement of the cam through an arc of 180 degrees from the full-line position illustrated in FIG. 2 will shift the cam ⅛ inch to the right, as viewed in FIG. 2. It will be appreciated that, since the tracks for the upper and lower track and hinge assemblies can both be shifted, a substantial degree of adjustment of the hinge position can be accomplished, and this is sufficient to overcome the conventional hinge sag attributed to improperly squaring of the window frame and poor hinge positioning by the manufacturer of the casement window unit. After the track for the upper and lower track and hinge assemblies has been adjusted, the screws 39 may be tightened, thereby completing the window installation.

It will, therefore, be seen that the provision of the cam, the slight modification of the screw openings in the horizontal tracks of the track and hinge assemblies, and the slight shortening of the length of the track thereby allows an installer or homeowner to readily adjust the position of the hinge and thereby overcome substantially all sash sag associated with the installation of casement windows.

Thus, it will be seen that I have provided a conventional casement sash unit with a unique cam arrangement, of simple and inexpensive construction, which permits ready adjustment of the hinge position during installation of the casement window units, thereby saving time and labor and overcoming a common window installation problem.

What is claimed is:

1. A track and hinge assembly set for use with a casement window sash unit mounted on a window frame of a building, the window frame including upper and lower horizontal frame members connected by vertical frame members, said track assembly set comprising similar upper and lower track and hinge assemblies, each track and hinge assembly including an elongate horizontal L-shaped track secured to one of the horizontal frame members, a hinge mechanism including a pair of pivotally interconnected links, one of which is pivotally connected to the track, and the other link is secured to the casement sash and is slidably connected with the track for shifting the casement sash between open and closed positions, each track having, a plurality of longitudinally spaced apart, and longitudinally elongated openings therein, a plurality of attachment screws, each extending through an opening for attaching each track to one of the horizontal window frame members, each opening shaped to permit a predetermined amount of longitudinal movement of the track in opposite directions relative to the window frame and the attaching screw when the attaching screw is in a centered position in an opening, each track having a cam opening therein, said cam opening having an edge defining a cam surface, each track having a cam positioned in the track cam opening and engaging the cam surface, an attachment screw extending through a first opening in the cam and into the associated horizontal window frame member, said cam being shiftable from a center position in either direction to shift the track a predetermined amount relative to the associated horizontal window frame before the attachment screws are tightened to adjust the position of the hinge relative to the window frame and to thereby overcome sash sag.

2. The track and hinge assembly set as defined in claim 1 wherein said cam for each track has a cam element projecting into the cam opening in the track.

3. The track and hinge assembly set as defined in claim 1 wherein.. said cam for each track has a second opening therein adjacent to the first opening and shaped to accommodate a screw driver for facilitating shifting of the cam.

4. The track and hinge assembly set as defined in claim 3 wherein said cam for each track has an embossment on the upper surface thereof, and said second opening extends through said embossment.

* * * * *